US008651876B2

(12) United States Patent
Mysliwiec et al.

(10) Patent No.: US 8,651,876 B2
(45) Date of Patent: Feb. 18, 2014

(54) CONNECTOR SYSTEMS WITH MAGNETIC RETAINING MEANS

(75) Inventors: Wojciech Mysliwiec, Rochester, NY (US); Mark Benoit, Rochester, NY (US); Richard Furness, Kent, NY (US)

(73) Assignee: Harris Corporation, Melbourne, FL (US)

( * ) Notice: Subject to any disclaimer, the term of this patent is extended or adjusted under 35 U.S.C. 154(b) by 238 days.

(21) Appl. No.: 13/343,198

(22) Filed: Jan. 4, 2012

(65) Prior Publication Data

US 2013/0171840 A1 Jul. 4, 2013

(51) Int. Cl.
*H01R 11/30* (2006.01)

(52) U.S. Cl.
USPC ..... 439/39

(58) Field of Classification Search
USPC ..... 439/39, 40, 374
See application file for complete search history.

(56) References Cited

U.S. PATENT DOCUMENTS

| | | | | |
|---|---|---|---|---|
| 7,775,801 | B2 * | 8/2010 | Shiff et al. | 439/39 |
| 7,789,667 | B2 * | 9/2010 | Zhu et al. | 439/39 |
| 8,087,939 | B2 * | 1/2012 | Rohrbach et al. | 439/39 |
| 8,348,678 | B2 * | 1/2013 | Hardisty et al. | 439/39 |
| 8,435,042 | B2 * | 5/2013 | Rohrbach et al. | 439/39 |

* cited by examiner

*Primary Examiner* — Khiem Nguyen
(74) *Attorney, Agent, or Firm* — Fox Rothschild LLP; Robert J. Sacco

(57) ABSTRACT

Connector systems (10, 100) for electrically connecting two or more electrical components include a connector (14, 114) having one or more magnets (36*a*, 136*a*). Each magnet (36*a*, 136*a*) is attracted to another magnet (36*b*, 136*b*), or to a magnetically-attractable element on the other connector (14, 114) of the system (10, 100) when the connectors (14, 12, 112, 114) are mated. The magnetic attraction helps to maintain the connectors (14, 12, 112, 114) in a mated condition. The magnets (36*a*, 36*b*, 136*a*, 136*b*) can be oriented so that surface normals of pole faces (37*a*, 37*b*, 137*a*, 137*b*) of the magnets (36*a*, 36*b*, 136*a*, 136*b*) are angled in relation to a mating direction of the connectors (14, 12, 112, 114).

23 Claims, 6 Drawing Sheets

CONNECTOR SYSTEMS WITH MAGNETIC RETAINING MEANS

BACKGROUND OF THE INVENTION

1. Statement of the Technical Field

The inventive arrangements relate to connector systems for electrically connecting two or more electrical components.

2. Description of Related Art

Electrical cables are commonly used to electrically connect two or more electrical components. An electrical cable may include connectors at one or both ends for electrically and mechanically connecting the electrical cable to the electrical components. For example, a connector in the form of a plug may be located at one end of the cable. The plug is capable of mating with a connector in the form of a receptacle on the electrical component, to form electrical and mechanical connections between the cable and the electrical component.

Connector systems are often equipped with a means for retaining the connectors in a mated condition. For example, a connector can be equipped with fasteners that engage mechanical features on its mating connector in a manner that prevents movement of the connectors in a direction opposite their mating direction. As another example, connectors can be equipped with interlocking features that engage and disengage when the connectors are pushed, twisted, or otherwise manipulated during mating and un-mating.

The need to tighten and loosen fasteners can add to the time and effort needed to mate and un-mate the connectors, and can necessitate the use of tooling to mate and un-mate the connectors. The need to push, twist, or otherwise manipulate connectors during mating and un-mating can likewise add to the time and effort needed to mate and un-mate the connectors, and can necessitate the use of two hands to mate and un-mate the connectors. Moreover, the need for such steps can make mating and un-mating the connectors particularly difficult under darkness and other low-visibility conditions. The resulting delays in the ability to use or disconnect the electrical components associated with the connectors can be significant, for example, to first responders such as emergency medical technicians and firemen operating under emergency conditions, or to military personnel during combat operations.

SUMMARY OF THE INVENTION

Embodiments of connector systems include a first connector. The first connector can have a housing, and first contacts mounted on the housing. The first contacts are configured to mate in a first direction with second contacts of a second connector. The first connector can also include conductors each being electrically connected to an associated one of the first contacts. The connector can further include a magnet mounted on the housing. The magnet has a pole face. The first housing and the magnet are configured so that a normal to the pole face extends in a second direction.

In accordance with further aspects of the inventive concepts disclosed herein, embodiments of connector systems can include a connector. The connector can have a housing, and a plurality of contacts mounted on the housing. The contacts are configured in an array so that ends of the contacts are positioned substantially in a first plane. The connector also includes conductors. Each of the conductors is electrically connected to an associated one of the contacts. The connector further includes a magnet mounted on the housing. The magnet is positioned at least in part in a recess that extends inwardly from a surface of the housing. The surface is disposed substantially in a second plane, and the second plane is angularly offset from the first plane.

BRIEF DESCRIPTION OF THE DRAWINGS

Embodiments will be described with reference to the following drawing figures, in which like numerals represent like items throughout the figures and in which.

DETAILED DESCRIPTION

Figure 1:
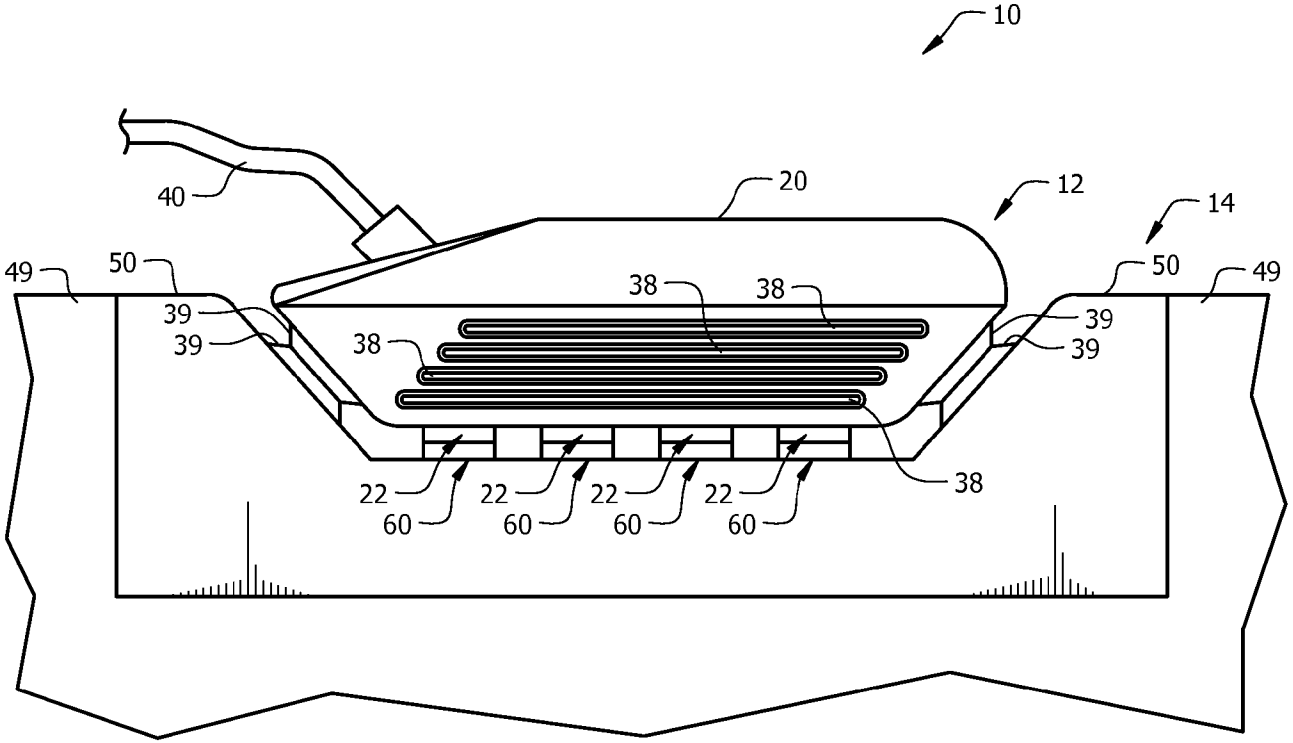
FIG. 1 is a top view of a connector system having a receptacle integrated into a notebook computer, depicting the receptacle mated with a plug of the connector system.

The invention is described with reference to the attached figures. The figures are not drawn to scale and they are provided merely to illustrate the instant invention. Several aspects of the invention are described below with reference to example applications for illustration. It should be understood that numerous specific details, relationships, and methods are set forth to provide a full understanding of the invention. One having ordinary skill in the relevant art, however, will readily recognize that the invention can be practiced without one or more of the specific details or with other methods. In other instances, well-known structures or operation are not shown in detail to avoid obscuring the invention. The invention is not limited by the illustrated ordering of acts or events, as some acts may occur in different orders and/or concurrently with other acts or events. Furthermore, not all illustrated acts or events are required to implement a methodology in accordance with the invention.

FIGS. 1-4 depict an embodiment of a connector system 10. The connector system 10 comprises a first connector in the form of a plug 12, and a second connector in the form of a receptacle 14. The plug 12 mates with the receptacle 14 to form an electrical connection between two or more electrical components such as a notebook computer 49, shown in part in FIG. 1, and a server (not shown). The use of the connector system 10 in conjunction with a notebook computer 49 and a server is disclosed for exemplary purposed only. The connector system 10 can be used in conjunction with other types of electrical components.

The plug 12 includes a housing 20, and four arrays 22 of pin-type contacts 24. The housing 20 can be formed from a suitable electrically-insulative material such as high-impact plastic. Each array 22 is mounted on a first surface 32*a* of the housing 20 by a suitable means such as adhesive or fasteners, so that the contacts 24 face outwardly, i.e., away from the housing 20, and the freestanding ends of the contacts 24 are disposed substantially in a common plane denoted in FIG. 3 by the reference character 25. Because the arrays 22 are mounted on the first surface 32*a*, the plane 25 is substantially parallel to the first surface 32*a*. A rearward side of each array 20 faces into an internal volume 28 of the housing 20. The internal volume 28 is depicted in the partial cutaway view of FIG. 3. Each of the contacts 24 is configured to mate with a corresponding receptacle contact 62 of the receptacle 14, in a mating direction denoted by the arrow 26 in FIG. 3.

Alternative embodiments of the plug 12 can be equipped with more, or less than four of the arrays 20, depending upon the requirements of the particular application for the connector system 10. Contacts other than pin-type contacts 24 can be used in alternative embodiments of the plug 12. Directional terms used herein to describe the connector system 10, such as up, down, top, bottom, horizontal, vertical, downward, upward, etc., are used with reference to the component orientations depicted in FIG. 3.

Figure 2:
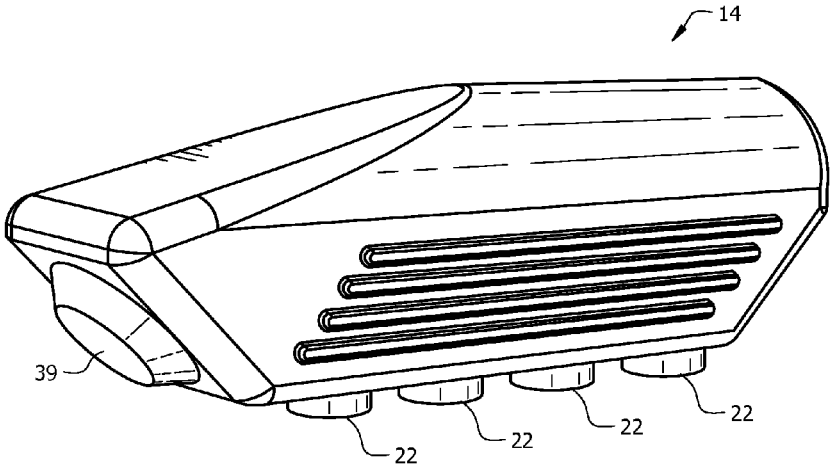
FIG. 2 is a rear perspective view of the plug of the connector system shown in FIGS. 1 and 2.
Figure 3:
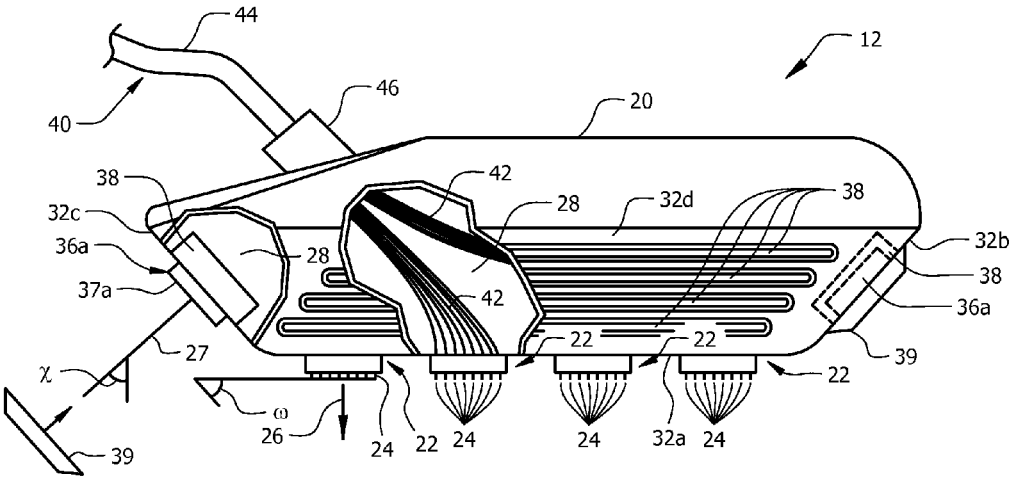
FIG. 3 is a partial cutaway view of the plug of the connector system shown in FIGS. 1 and 2, taken from the perspective of FIG. 1.

The housing 12 also includes a second surface 32*b*, and a third surface 32*c*. The second and third surfaces 32*b*, 32*c* each adjoin the first surface 32*a*, as shown in FIGS. 1-3. The respective planes defined by the second and third surfaces 32*b*, 32*c* are angled in relation to the plane 21, by an angle denoted in FIG. 3 using the reference character "ω." The angle ω is approximately 45°. The optimal value for ω is application dependant; a specific value for ω is disclosed for exemplary purposes only.

The housing 12 also includes two side surfaces 32*d*. The housing 20 can include ribs 38 that extend along the side surfaces 32*d*, to assist the user in forming a grip on the plug 12 during mating and un-mating of the plug 12 and receptacle 14. Alternative embodiments of the plug 12 can include other suitable features, such as recesses, indentations, etc., to assist the user in maintaining a grip on the plug 12.

The plug 12 also includes two permanent magnets 36*a*. The magnets 36*a* can be, for example, N52 neodynium magnets. Each magnet 36*a* has a substantially planar pole face 37*a*, i.e., an end that faces the air gap in which the magnetic field of the magnet 36*a* performs useful work, as shown in FIG. 3. The magnets 36*a*, as discussed below, help to retain the plug 12 in a mated condition with the receptacle 14.

Each of the magnets 36*a* is securely mounted on an associated open-ended enclosure in the form of cup 38, using a suitable means such as adhesive. The cups 38 are depicted in FIG. 3. One of the cups 38 is securely mounted on the housing 12 within a recess that extends inward from the second surface 32*b*, so that the associated magnet 36*a* extends through the plane defined by the second surface 32*b*, and the pole face 37*a* of the magnet 36*a* lies in a plane that is substantially parallel to the plane defined by the second surface 32*b*.

The other cup 38 is mounted on the housing 12 within a recess that extends inward from the third surface 32*c*, so that the associated magnet 36*a* extends through the plane defined by of the third surface 32*c*, and the pole face 37*a* of the magnet 36*a* lies in a plane that is substantially parallel to the plane defined by the third surface 32*c*. The cups 38 can be formed from a material, such as stainless steel or other ferrous materials, that attenuates the magnetic flux from the magnets 36*a*, thereby reducing the amount of magnetic flux that enters the housing 20.

A surface normal, or normal to each pole face 37*a* of the magnets 36*a* is denoted in FIG. 3 using the reference character 27. The normal 27 to each pole face 37*a* is angularly offset in relation to the mating direction 26 of the contacts 24, by an angle denoted in FIG. 3 using the reference character "ϕ." The angle ϕ is approximately equal to the angle ω.

The probe 12 includes two covers 39, shown in FIGS. 1-3. Each cover 39 encloses an associated one of the magnets 36*a*. The covers 39 can be formed from a material, such as impact-resistant plastic, that protects the magnets 36*a* from impact without substantially attenuating the magnetic flux of the magnets 36*a*. The covers 39 also isolate the magnets 36*a* from the environment, and can thereby protect the magnets 36*a* from corrosion and other adverse environmental effects.

The plug 12 further comprises a cable 40. The cable 40 includes a plurality of insulated conductors 42 encased in an outer sheath 44, visible in FIG. 3. The cable 40 enters the housing 20 through an opening formed in an upper surface of the housing 20, and can include a strain-relief sleeve 46 that engages the housing 20. The conductors 42 extend through the internal volume 28 within the housing 20, as shown in FIG. 3. Each conductor 42 is electrically and mechanically connected to an associated one of the contacts 24 in one of the arrays 22 by a suitable means such as soldering.

Figure 4:
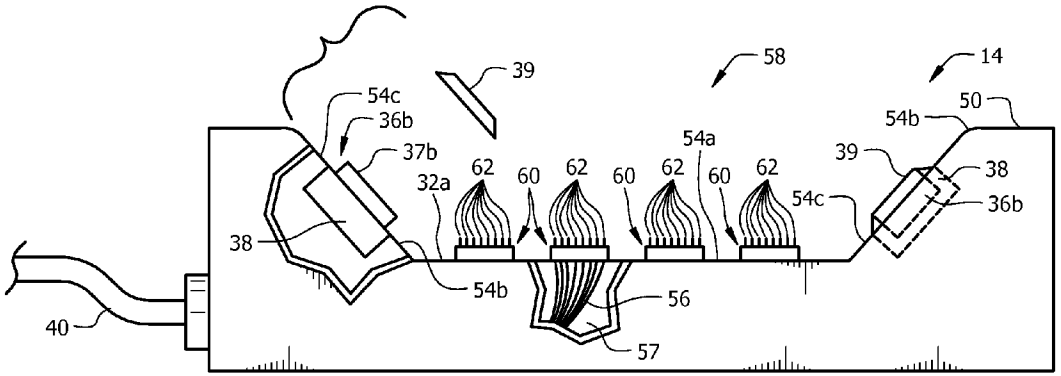
FIG. 4 is a partial cutaway view of the receptacle of the connector system shown in FIGS. 1-3, depicting the receptacle as a stand-alone component.

The receptacle 14 can be a stand-alone structure. Alternatively, the receptacle 14 can be integrated into the component to which the receptacle 14 is interconnected. For example, the receptacle 14 is depicted in FIG. 1 as being integrated into the notebook computer 49. FIG. 4 depicts the receptacle 14 as a stand-alone receptacle with a cable such as the cable 40 described above in relation to the plug 12.

The receptacle 14 comprises a housing 50. The housing 50 can be formed from a suitable electrically-insulative material such as high-impact plastic. The housing 50 includes a first surface 54*a*, a second surface 54*b*, and a third surface 54*c*. The first surface 54*a* faces outwardly, i.e., away from the housing 50. The first surface 54*a* adjoins, and is positioned between the second and third surfaces 54*b*, 54*c*.

The receptacle 14 also includes four arrays 60 of the receptacle contacts 62, as shown in FIGS. 1 and 4. Each array 60 is mounted on the first surface 54*a* of the housing 50 by a suitable means such as adhesive or fasteners, so that the contacts 62 face outwardly, and the freestanding ends of the contacts 62 are disposed substantially in a common plane as described above in relation to the contact arrays 22 of the plug 12. Because the arrays 60 are mounted on the first surface 54*a*, the common plane is substantially parallel to the first surface 54*a*. The arrays 60 are positioned so that each receptacle contact 62 aligns and mates with an associated one of the pin-type contacts 24 on the plug 12 when the plug 12 and the receptacle 14 are fully mated, as shown in FIG. 1.

The receptacle 14 can include a plurality of conductors 56 that extend through an internal volume 57 within the housing 50, as shown in FIG. 4. Each conductor 56 is electrically and mechanically connected to an associated one of the contacts 62 in one of the arrays 60 by a suitable means such as soldering. The conductors 56 can be part of the cable 40 in applications where the receptacle 14 is a stand-alone component. The conductors 56 can run directly to internal circuitry of the notebook computer 49 or other electrical component in applications where the receptacle 14 is integrated into the notebook computer 49 or other electrical component.

The respective planes defined by the second and third surfaces 54*b*, 54*c* are angled in relation to the common plane defined by the freestanding ends of the contacts 62, by an angle that is approximately equal to the angle ω associated with the plug 12.

The receptacle 14 also includes two permanent magnets 36*b* each having a substantially planar pole face 37*b*, as illustrated in FIG. 4. The magnets 36*b* are substantially identical to the magnets 36*a* of the plug 12. Each of the magnets 36*b* is securely mounted on an associated cup 38 that is substantially identical to the cups 38 of the plug 12, using a suitable means such as adhesive. One of the cups 38 is securely mounted on the housing 50 of the receptacle 14 within a recess that extends inward from the second surface 54*b*, so that the associated magnet 36*b* extends through the plane of the second surface 54*b*, and the pole face 37*b* of the magnet 36*b* lies in a plane that is substantially parallel to the plane defined by the second surface 54*b* as depicted in FIG. 4. The other cup 38 is mounted on the housing 50 within a recess that extends inward from the second surface 54*c*, so that the associated magnet 36*b* extends through the plane of the second surface 54*c*, and the pole face 37*b* of the magnet 36*b* lies in a plane that is substantially parallel to the plane defined by the third surface 54*c*.

A normal to each pole face 37*b* of the magnets 36*b* is angled in relation to the mating direction 26 of the contacts 62, by an angle that is approximately equal to the angle ϕ associated with the plug 12.

Each magnet 36*b* is enclosed in a cover 39 that is substantially identical to the covers 39 associated with the magnets 36*a* of the plug 12.

The first, second, and third surfaces 54*a*, 54*b*, 54*c*, define a space or volume 58, as illustrated in FIG. 4. The first, second, and third surfaces 54*a*, 54*b*, 54*c* are configured so that the receptacle 14 fits within the volume 58 as depicted in FIG. 1 when the plug 12 is mated with the receptacle 14. In particular, the first surface 54*a* has a lengthwise dimension that is slightly larger than that of the first surface 32*a* of the plug 12. Moreover, as noted above, the angle between plane defined by the first surface 54*a*, and the planes defined by the second and third surfaces 54*b*, 54*c* is approximately equal to the angle ϕ associated with the plug 12.

The first surface 32*a* of the plug 12 faces the first surface 54*a* of the receptacle 14 when the plug 12 and the receptacle 14 are mated, thereby facilitating mating of the contacts 24, 62 as shown in FIG. 1. The second and third surfaces 32*b*, 32*c* of the plug 12 face the respective second and third surfaces 54*b*, 54*c* of the receptacle 14 when the plug 12 and the receptacle 14 are mated.

The pole face 37*a* of each magnet 36*a* on the plug 12 faces the pole face 37*b* of an associated magnet 36*b* on the receptacle 14 when the plug 12 and receptacle 14 are mated, so that the associated magnets 36*a*, 36*b* are attracted to each other due to the interaction between their receptive magnetic fields. Direct contact between the magnets 36*a*, 36*b* is precluded by the covers 39. The covers 39 can also attenuate impact forces on the magnets 36*a*, 36*b* that can arise when the associated pairs of magnets 36*a*, 36*b* are drawn into contact each other during the mating process, thereby protecting the magnets 36*a*, 36*b* from cracking or shattering due to such forces.

The aggregate force resulting from the magnetic attraction between each associated pair of magnets 36*a*, 36*b* draws the plug 12 and the receptacle 14 toward each other, and maintains the plug 12 in a mated condition with the receptacle 14. A user can un-mate the plug 12 from the receptacle 14 by grasping the plug 12 by the side surfaces 32*d*, and exerting a force on the plug 12 in a direction substantially opposite the mating direction 26.

The magnitude of the force required to un-mate the plug 12 from the receptacle 14 is related to the angle ϕ the between the mating direction 26, and the respective pole faces 37*a*, 37*b* of the magnets 36*a*, 36*b*. In particular, the amount of force required to separate each pair of magnets 36*a*, 36*b* increases as the direction of the applied force approaches a direction perpendicular to the pole faces 37*a*, 37*b* of the magnets 36*a*, 36*b*, and reaches its maximum when the direction of applied force is perpendicular of the pole faces 37*a*, 37*b*, i.e., when the angle ϕ equals zero. Correspondingly, the amount of force required to separate the magnets 36*a*, 36*b* reaches its minimum when the force is applied in a direction parallel to the pole faces 37*a*, 37*b*, i.e., when the when the angle ϕ equals 90° and the applied force is pure shear across the pole faces 37*a*, 37*b*.

The optimal value for the angle ϕ is application-dependent, and can vary with factors such as the desired or required magnitude of the retaining force on the plug 12, the magnitude of the magnetic force produced by each of the magnets 36*a*, 36*b*, and the desired or required dimensional footprint of the probe 12 or receptacle 14. In particular, increasing ϕ reduces the respective lengthwise dimensions of the probe 12 and receptacle 14. Thus, the angle ϕ can be chosen so as achieve an optimum balance between the mating or retaining force between the probe 12 and receptacle 14, and the overall size of the probe 12 and receptacle 14. The angled orientations of the magnets 36*a*, 36*b* can thus result in a more compact connector system 10 than would otherwise be possible, and/or can facilitate the incorporation of more contacts 24, 62 on the plug 12 and receptacle 14 than would otherwise be possible.

The magnets 36*a* are oriented on the plug 12 so that the respective polarities of the magnets 36*a* are reversed with respect to each other, i.e., the magnet 36*a* associated with the second surface 32*b* is oriented so that its north pole faces outwardly, away from the housing 20, while the magnet 36*a* associated with the third surface 32*b* is oriented so that its south pole faces outwardly. The magnets 36*b* likewise are oriented on the receptacle 14 so that the respective polarities of the magnets 36*b* are reversed with respect to each other, and with respect to their associated magnets 36*a* on the plug 12, i.e., the magnet 36*b* associated with the second surface 54*b* is oriented so that its south pole faces outwardly, away from the housing 50, while the magnet 36*b* associated with the third surface 54*b* is oriented so that its north pole faces outwardly.

The above-noted arrangement of the magnets 36*a*, 36*b* makes the mating of the plug 12 and receptacle 14 unidirectional, i.e., the plug 12 and receptacle 14 can only be mated when the plug 12 is oriented such that its first and second surfaces 32*b*, 32*c* face the respective first and second surfaces 54*b*, 54*c* of the receptacle 14. Any attempt to mate the plug 12 and receptacle 14 when the plug 12 is oriented in the opposite direction will result in the magnets 36*a* on the plug 12 being repelled by, rather than attracted to, the magnets 36*b* on the receptacle 14, since the polarities of each corresponding pair of magnets 36*a*, 36*b* will be the same when the plug 12 is oriented in this manner.

In alternative embodiments, the magnets 36*a* can be mounted on the plug 12 such that the polarities of the magnets 36*a* are the same with respect to each other; and the magnets 36*b* can be mounted on the receptacle 14 such that the polarities of the magnets 36*b* are the same with respect to each other. This arrangement permits bidirectional mating of the plug 12 and the receptacle 14, i.e., the plug 12 can be mated with the receptacle 14 when the plug 12 is oriented such that the first and second surfaces 32*b*, 32*c* face the respective first and second surfaces 54*b*, 54*c* of the receptacle 14, and vice versa.

In other alternative embodiments, the use of the magnets 36*a* or 36*b* can be eliminated, and disk or otherwise-shaped element formed from a magnetically-attractable material, i.e., a material that is attracted to magnets, can be used in lieu of the magnets 36*a* or the magnets 36*b*. For example, elements formed from stainless steel or another type of ferromagnetic material, shaped similarly to the magnets 36*a*, 36*b*, can be used in lieu of the magnets 36*a* or the magnets 36*b*. This type of arrangement can potentially lead to cost savings resulting from the need to procure only one set of magnets.

The magnets 36*a*, 36*b* are believed to be compact in relation to conventional mechanisms, such as latches or pins, that are commonly used to provide a mechanical connection between the two connectors of a connector system. Moreover, the magnets 36*a*, 36*b* can make the plug 12 self-guiding as it is mated with the receptacle 14. In particular, the interaction between the respective magnetic fields of each pair of magnets 36*a*, 36*b* during mating causes each magnet 36*a* to become centered with respect to its associated magnet 36*b*, which in turn aligns the plug 12 with the receptacle 14. This feature can assist the user in mating the plug 12 with the receptacle 14, particularly under darkness and other low or zero-visibility conditions.

The use of the magnets 36*a*, 36*b* to retain the plug 12 can eliminate any need to tighten or loosen and screws or other fasteners, or to twist, push, or otherwise manipulate the plug 12 in any manner other than pulling it away from the receptacle 14, when mating or un-mating the plug 12 and the receptacle 14. Mating and un-mating of the plug 12 and receptacle 14 can thus be achieved quickly, without the use of any tools, and using only one hand. The ability to mate and un-mate the plug 12 and receptacle 14 in this manner can potentially be of particular value, for example, to first responders operating under emergency conditions, and to military personnel during combat operations.

FIGS. 5-10 depict an alternative embodiment in the form of a connector system 100. The connector system 100 comprises a plug 112, and a receptacle 114 that mates with the plug 112 to form an electrical connection between two or more electrical components such as a notebook computer 49*a*, shown in part in FIG. 5, and a server (not shown). The use of the connector system 100 in conjunction with a notebook computer 49*a* and a server is disclosed for exemplary purposed only. The connector system 100 can be used in conjunction with other types of electrical components.

The plug 112 includes a housing 120. The housing 120 can be formed from a suitable electrically-insulative material such as high-impact plastic. The plug 112 also includes four of the arrays 22 of pin-type contacts 24 discussed above in relation to the plug 12. Each array 22 is mounted on a first surface 132*a* of a lower portion 127 of the housing 120 by a suitable means such as adhesive or fasteners, so that the freestanding ends of the contacts 24 are disposed substantially in a common plane denoted in FIG. 9 by the reference character 25. Because the arrays 22 are mounted on the first surface 132*a*, the plane 25 is substantially parallel to the first surface 132*a*. A rearward side of each array 20 faces into an internal volume 128 of the housing 120. The internal volume 128 is depicted in the cutaway view of FIG. 9. Each of the contacts 24 is configured to mate with a corresponding receptacle contact 62 of the receptacle 114, in a mating direction denoted by the arrow 26 in FIG. 9.

Alternative embodiments of the plug 112 can be equipped with more, or less than four of the arrays 20, depending upon the requirements of the particular application for the connector system 10. Contacts other than pin-type contacts 24 can be used in alternative embodiments of the plug 112. Directional terms appearing herein, such as up, down, top, bottom, horizontal, vertical, downward, upward, etc., are used with reference to the component orientations depicted in FIG. 9.

The lower portion 127 of the housing 120 also includes a second surface 132*b* and a third surface 132*c* that are located at the respective front and rear of the lower portion 127, and that each adjoin the first surface 132*a*. The lower portion 127 further includes a fourth and a fifth surface 132*d*, 132*e* that form the sides of the lower portion 127 and adjoin the first, second, and third surfaces 132*a*, 132*b*, 132*c*.

Figure 9:
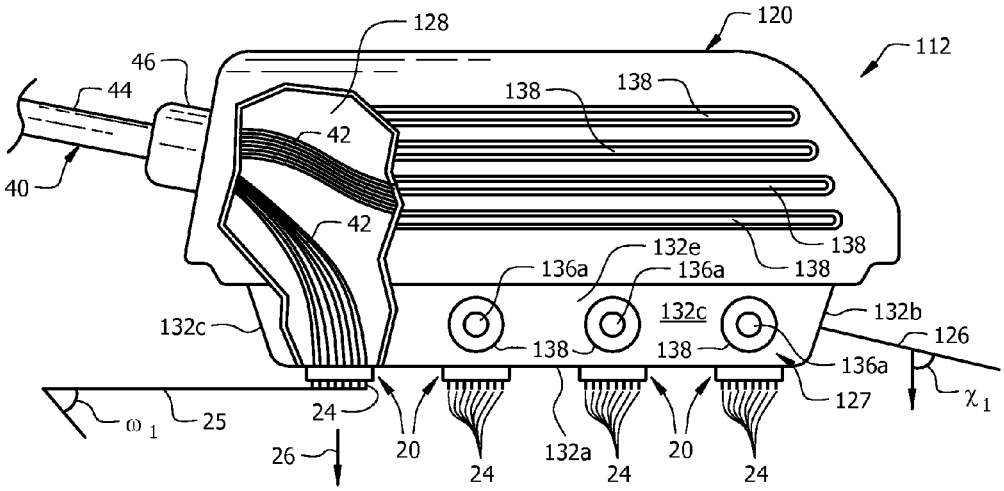
FIG. 9 is a partial cutaway view of the plug of the connector system shown in FIGS. 5-8, taken from the perspective of FIG. 5.

The respective planes defined by the second, third, fourth, and fifth surfaces 132*b*, 132*c*, 132*d*, 132*e* lie are angled in relation to the plane 121 by an angle denoted in FIG. 9 by the reference character "$\omega_1$." The angle $\omega_1$ is approximately 45°. The optimal value for $\omega_1$ is application dependant; a specific value for $\omega_1$ is disclosed for exemplary purposes only.

The plug 112 also includes ten permanent magnets 136*a*. The magnets 136*a* can be, for example, N52 neodynium magnets. Each magnet 136*a* has a substantially planar pole face 137*a*.

Each of the magnets 136*a* is securely mounted on an associated open-ended enclosure in the form of a cup 137, using a suitable means such as adhesive. One of the cups 137 is securely mounted on the housing 120 within a recess that extends inward from the second surface 132*b*, so that the pole face 137*a* of the associated magnet 136*a* is substantially flush, i.e., co-planar, with the second surface 132*b*. Another cup 137 is similarly mounted on the housing 120 within a recess that extends inward from the third surface 132*c*. Four cups 137 are similarly mounted within recesses that extends inward from the fourth surface 132*d*, and four cups 137 are similarly mounted within recesses that extend inward from the fifth surface 132*e*.

The cups 137 can be formed from a material, such as stainless steel or other ferrous materials, that attenuates the magnetic flux from the magnets 136*a*, thereby reducing the amount of magnetic flux entering the housing 120.

A normal to the pole faces 37*a* of the magnets 36*a* is denoted in FIG. 9 by the reference character 126. The normal 126 to each pole face 37*a* is angled in relation to the mating direction 26 of the contacts 24, by an angle denoted in FIG. 9 using the reference character "$\phi_1$." The angle $\phi_1$ is approximately equal to the angle $\omega_1$.

The optimal number of magnets 136*a* is application-dependent, and can vary with factors such as the desired or required magnitude of the retaining force on the plug 112, the magnitude of the magnetic force produced by each of the magnets 136*a*, etc.

An upper portion of the housing 120 can include ribs 138 that extend along the sides thereof, to assist the user in forming a grip on the plug 112 during mating and de-mating with the receptacle 114. Alternative embodiments of the plug 112 can include other suitable features, such as recesses or indentations, to assist the user in forming a grip on the plug 112.

The plug 112 can include a cable such as the cable 40 of the plug 12. The cable 40 enters the housing 120 through an opening formed in the back of the housing 120, and can include a strain-relief sleeve 46 that engages the housing 120. The conductors 42 extend through the internal volume 128 within the housing 120, as shown in the cutaway view of FIG. 9. Each conductor 42 is electrically and mechanically connected to an associated one of the contacts 24 in one of the arrays 22 by a suitable means such as soldering.

Figure 5:
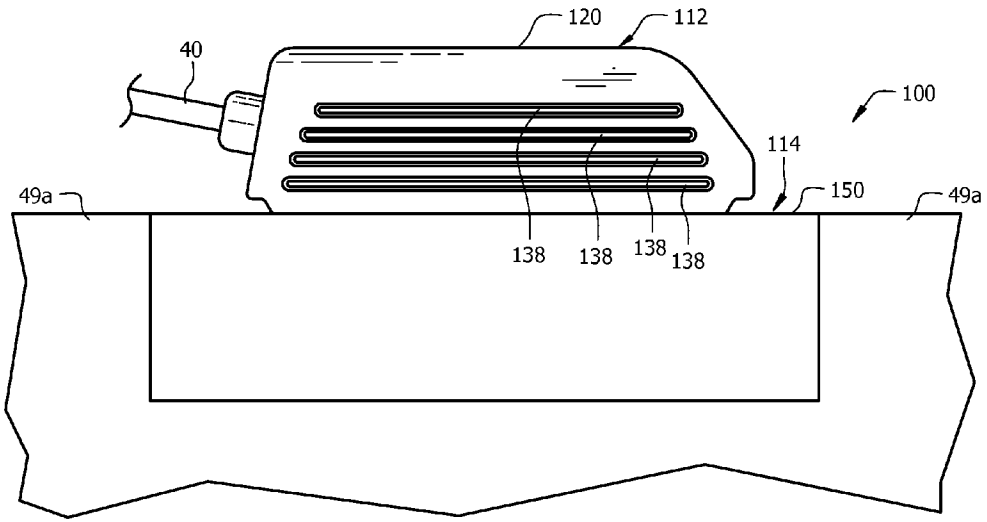
FIG. 5 is a top view of an alternative embodiment of the connector system shown in FIGS. 1-4, the alternative embodiment having a receptacle integrated into a notebook computer, and depicting the receptacle mated with a plug of the alternative embodiment.
Figure 6:
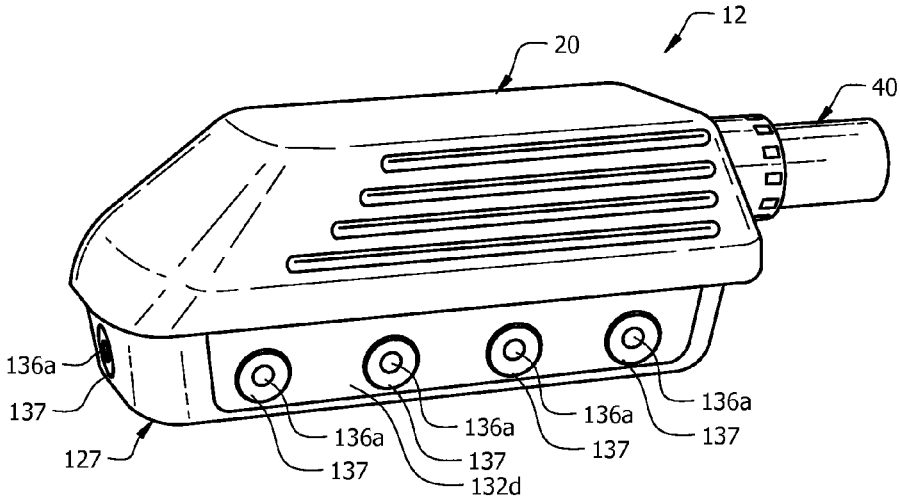
FIG. 6 is a front perspective view of the plug of the connector system shown in FIG. 5.
Figure 7:
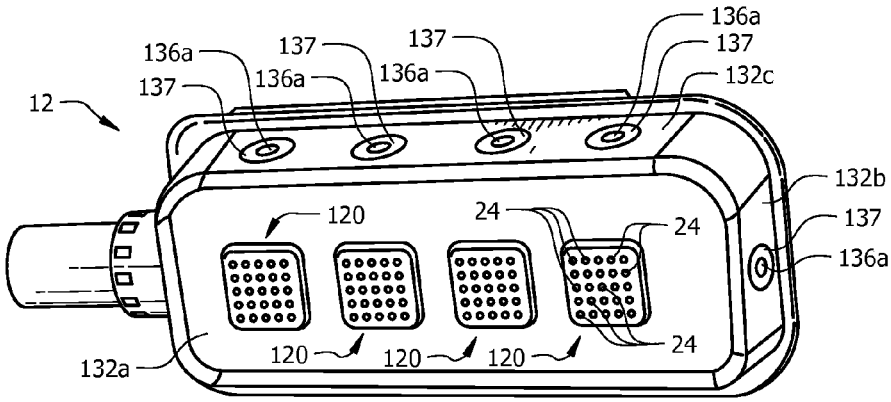
FIG. 7 is a bottom perspective view of the plug of the connector system shown in FIGS. 5 and 6.
Figure 10:
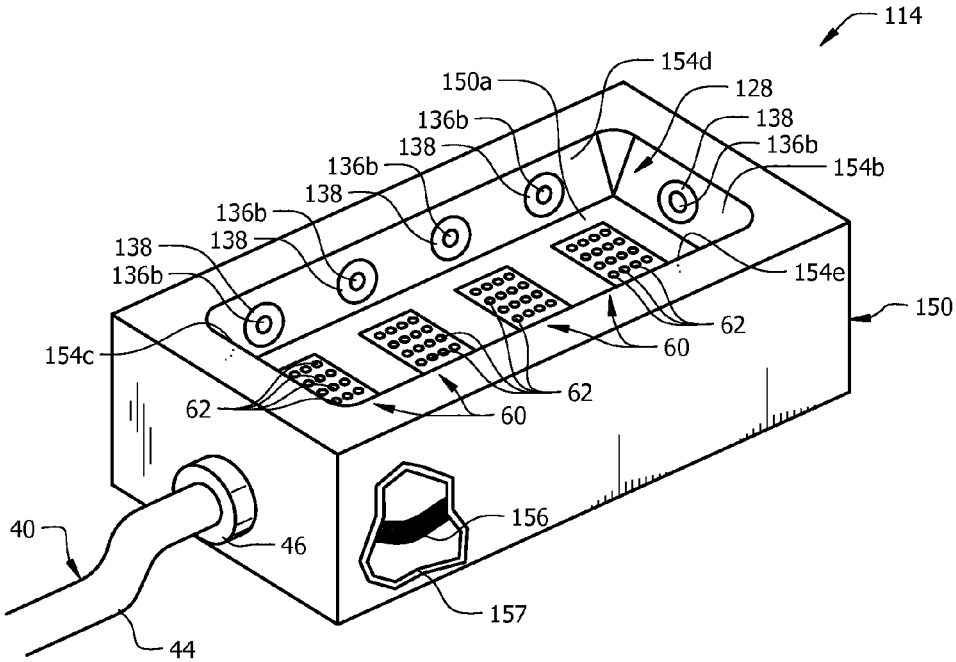
FIG. 10 is a partial cutaway, front perspective view of the receptacle of the connector system shown in FIGS. 5-9, depicting the receptacle as a stand-alone component.

The receptacle 114 can be a stand-alone structure, or can be integrated into the component to which the receptacle 114 is interconnected. For example, the receptacle 114 is depicted in FIG. 5 as being integrated into the notebook computer 49*a*. FIG. 10 depicts the receptacle 114 as a stand-alone receptacle with a cable such as the cable 40 described above in relation to the plug 12.

The receptacle 114 comprises a housing 150. The housing 150 can be formed from a suitable electrically-insulative material such as high-impact plastic.

Figure 8:
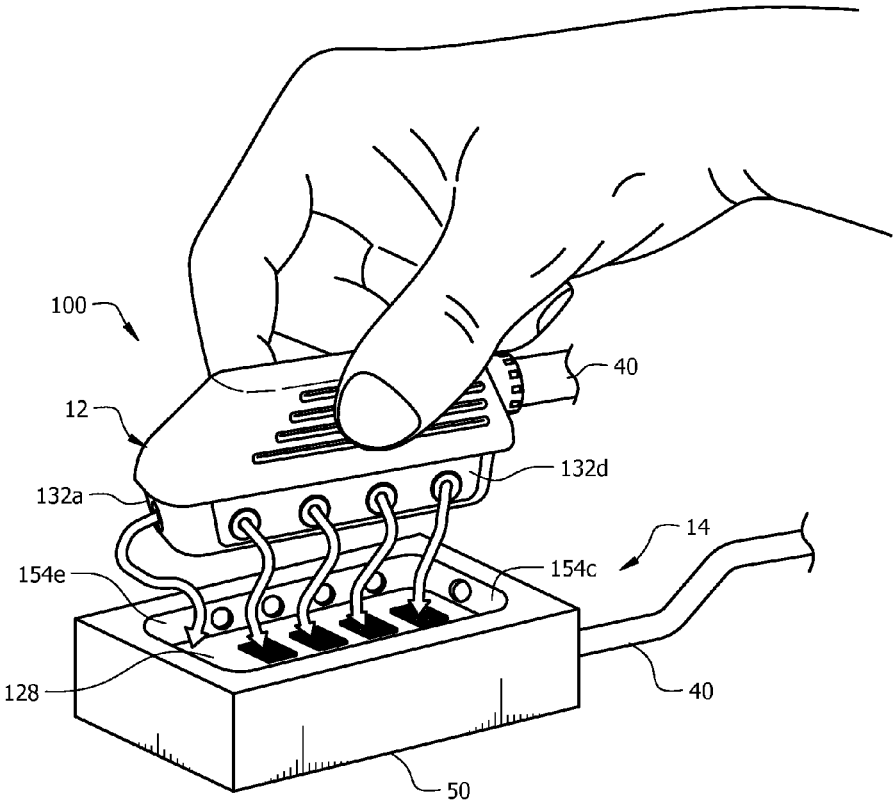
FIG. 8 is a front perspective view of the connector system shown in FIGS. 5-7, depicting the plug being un-mated from the receptacle of the connector system.

The housing 150 includes a first surface 154*a* that faces outwardly, away from the housing 50, as shown in FIG. 10. The housing 150 also includes a second surface 154*b*, and a third surface 154*c* that each adjoin the first surface 153*a*, as depicted in FIGS. 8 and 10. The housing 150 further includes a fourth surface 154*b*, and a fifth surface 154*e* that each adjoin the first, second, and third surfaces 154*a*-154*c*.

The receptacle 114 also includes four of the arrays 60 of receptacle contacts 62 discussed above in relation to the plug 112. Each array 60 is mounted on the first surface 154*a* of the housing 150 by a suitable means such as adhesive or fasteners, so that the contacts 162 face outwardly, and the freestanding ends of the contacts 62 are disposed substantially in a common plane as described above in relation to the contact arrays 22 of the plug 112. Because the arrays 60 are mounted on the first surface 154*a*, the common plane is substantially parallel to the first surface 154*a*. The arrays 60 are positioned so that each receptacle contact 62 aligns and mates with an associated one of the pin-type contacts 24 on the plug 112 when the plug 112 and the receptacle 114 are fully mated.

The receptacle 114 can include a plurality of conductors 156 that extend through an internal volume 157 within the housing 150, as shown in FIG. 10. Each conductor 156 is electrically and mechanically connected to an associated one of the contacts 162 in one of the arrays 160 by a suitable means such as soldering. The conductors 156 can be part of the cable 40 in applications where the receptacle 114 is a stand-alone component. The conductors 156 can run directly to internal circuitry of the notebook computer 49*a* or other electrical component in applications where the receptacle 114 is integrated into the notebook computer 49*a* or other electrical component.

The respective planes defined by the second through fifth surfaces 154*b*, 154*e* are angled in relation to the common plane defined by the freestanding ends of the contacts 62, by an angle that is approximately equal to the angle ω associated with the plug 112.

The receptacle 114 also includes ten permanent magnets 136*b* each having a substantially planar pole face 137*b*. The magnets 136*b* are substantially identical to the magnets 136*a* of the plug 12. Each of the magnets 136*b* is securely mounted on an associated cup 137 that is substantially identical to the cups 137 of the plug 112, using a suitable means such as adhesive.

One of the cups 137 is securely mounted on the housing 150 within a recess that extends inward from the second surface 154*b*, so that the pole face 137*b* of the associated magnet 136*b* lies substantially flush with the second surface 154*b*. Another cup 137 is similarly mounted on the housing 150 within a recess that extends inward from the third surface 154*c*. Four cups 137 are similarly mounted within recesses that extend inward from the fourth surface 154*d*, and four cups 137 are similarly mounted within recesses that extend inward from the fifth surface 154*e*, so that the pole faces 137*b* of the associated magnets 136*b* lie substantially flush with the fourth or fifth surfaces 154*d*, 154*e*.

A normal to each pole face 137*b* of the magnets 136*b* is angled in relation to the mating direction 26 of the contacts 62, by an angle that is approximately equal to the angle ϕ associated with the plug 112.

The first through fifth surfaces 154*a*-154*e* define a space or volume 128 within the housing 150, as illustrated in FIGS. 8 and 10. The volume 128 has dimensions that approximately match those of the lower portion 127 of the housing 120 of the plug 112, so that the lower portion 127 fits within the volume 128 with minimal clearance between the second through fifth surfaces 155*b*-154*e* and the respective second through fifth surfaces 132*b*-132*e* of the plug 112. In particular, the dimensions of the first through fifth surfaces 154*a*-154*e* of the receptacle 114 are slightly larger than those of the respective first through fifth surface 132*a*-132*e* of the plug 112. Moreover, as noted above, the angle between plane defined by the first surface 154*a*, and the planes defined by the second through and fifth surfaces 154*b*-154*e* is approximately equal to the angle ϕ associated with the plug 112.

The first surface 132*a* of the plug 112 faces the first surface 154*a* of the receptacle 114 when the plug 112 and the receptacle 114 are mated, thereby facilitating mating of the contacts 24, 62.

The second through fifth surface 132*b*-132*e* of the plug 112 face the respective second through fifth surfaces 154*b*-154*e* of the receptacle 114 when the plug 112 and the receptacle 114 are mated. Each magnet 136*a* on the plug 112 faces an associated magnet 136*b* on the receptacle 114 when the plug 112 and receptacle 114 are mated, so that the associated magnets 136*a*, 136*b* are attracted to each other due to the interaction between their receptive magnetic fields.

The aggregate force resulting from the magnetic attraction between each associated pair of magnets 136*a*, 136*b* maintains the plug 112 in a mated condition with the receptacle 114. A user can un-mate the plug 112 from the receptacle 114 by grasping the plug 112 by the side surfaces of the upper portion 137 of the housing 120, and exerting a force on the plug 112 in a direction substantially opposite the mating direction 26.

The magnets 136*a*, 136*b* can be oriented so as to facilitate unidirectional or bidirectional mating, as discussed above in relation to the connector system 10. Moreover, pieces of magnetically-attractive material can be used in lieu of the magnets 136*a* or the magnets 136*b* in alternative embodiments, as also discussed above in relation to the connector system 10.

We claim:

1. A connector system comprising a first connector, the first connector comprising:

a first housing;

a plurality of first contacts mounted on the first housing and being configured to mate in a first direction with a plurality of second contacts of a second connector;

a plurality of first conductors, each of the first conductors being electrically connected to an associated one of the first contacts; and a first magnet mounted on the housing and having a pole face, wherein the first housing and the first magnet are configured so that a normal to the pole face extends in a second direction.

2. The connector system of claim 1, wherein the first and second directions are offset by a first angle, the first angle being no greater than approximately 90o.

3. The connector system of claim 1, further comprising the second connector, the second connector comprising:

a second housing;

the plurality of the second contacts, the second contacts being mounted on the second housing;

a plurality of second conductors, each of the second conductors being electrically connected to an associated one of the second contacts; and a second magnet mounted on the second housing and having a pole face, wherein the second housing and the second magnet are configured so that an orientation of the pole face of the second magnet is approximately equal to an orientation of the pole face of the first magnet and the first and second magnets are subject to a mutual magnetic attraction when the first and second connectors are in a mated condition.

4. The connector system of claim 1, further comprising the second connector, the second connector comprising:

a second housing;

the plurality of the second contacts, the second contacts being mounted on the housing of the second connector;

a plurality of second conductors, each of the second conductors being electrically connected to an associated one of the second contacts; and a magnetically-attractable element mounted on the housing, wherein the second housing and the magnetically-attractable element are configured so that an orientation of a major surface of the magnetically-attractable element is approximately equal to an orientation of the pole face of the first magnet and the magnetically-attractable element is magnetically attracted to the first magnet when the first and second connectors are in a mated condition.

5. The connector system of claim 1, wherein the connector further comprises a second magnet mounted on the housing, the first and second magnets each having a magnetic pole, wherein the first and second magnets are configured so that an orientation of the magnetic pole of the first magnet in relation to the housing is substantially opposite an orientation of the magnetic pole of the second magnet in relation to the housing.

6. The connector system of claim 5, wherein the first and second magnets are located at or proximate opposite ends of the housing.

7. The connector system of claim 1, further comprising an open-ended enclosure mounted on the housing, wherein the enclosure comprises a material that attenuates magnetic flux, and the first magnet is mounted in the enclosure.

8. The connector system of claim 7, wherein the material that attenuates magnetic flux is a ferrous material.

9. The connector system of claim 1, further comprising a cover mounted on the housing, wherein the cover and the housing are configured so that the magnet is fully enclosed.

10. The connector system of claim 8, wherein the cover comprises an impact-resistant material.

11. The connector system of claim 2, wherein the first angle is approximately 45°.

12. The connector system of claim 1, wherein the first connector is a plug and the second connector is a receptacle.

13. The connector system of claim 1, wherein the first contacts are mounted in an array, the array is mounted on a substantially planar mating surface of the housing, and the mating surface is disposed substantially in a plane oriented perpendicular to the first direction.

14. A connector system comprising a first connector, the first connector comprising:

a first housing;

a plurality of first contacts mounted on the first housing and being configured in an array so that ends of the first contacts are disposed substantially in a first plane;

a plurality of first conductors, each of the first conductors being electrically connected to an associated one of the first contacts; and a first magnet mounted on the housing, the first magnet being positioned at least in part in a recess that extends inwardly from a first surface of the housing, wherein the first surface is disposed substantially in a second plane, the second plane being angularly offset from the first plane.

15. The connector system of claim 14, further comprising a second connector, the second connector comprising:

a second housing;

a plurality of second contacts, the second contacts being mounted on the housing of the second connector and being configured to mate with the first contacts when the first and second connectors are in a mated condition;

a plurality of second conductors, each of the second conductors being electrically connected to an associated one of the second contacts; and at least one of a second magnet and a magnetically-attractable element mounted on the second housing and being operable with the first magnet to exert forces on the first and second that urge the first and second connectors toward each other.

16. The connector system of claim 14, wherein the first connector is a plug and the second connector is a receptacle.

17. The connector system of claim 14, wherein the first contacts are configured to mate with second contacts of a second connector in a first direction, the first magnet has a pole face, and the first housing and the first magnet are configured so that a normal to the pole face is angularly offset from the first direction.

18. The connector system of claim 14, further comprising a second magnet mounted on the housing, the second magnet being positioned at least in part in a recess that extends inwardly from a second surface of the housing, wherein the second surface is disposed substantially in a third plane, the third plane being angularly offset from the first plane.

19. The connector system of claim 14, wherein the first and second surfaces are front and rear surfaces of the first housing.

20. The connector system of claim 16, wherein the first and second surfaces are side surfaces of the first housing.

21. The connector system of claim 14, wherein the second plane is angularly offset from the first plane by an angle no greater than approximately 90°.

22. The connector system of claim 14, wherein the second plane is angularly offset from the first plane by approximately 45°.

23. The connector system of claim 14, further comprising an open-ended enclosure mounted on the housing, wherein the enclosure comprises a material that attenuates magnetic flux, and the first magnet is mounted in the enclosure.

* * * * *